US009016485B1

(12) United States Patent
Liu

(10) Patent No.: US 9,016,485 B1
(45) Date of Patent: Apr. 28, 2015

(54) COMBINATION RACK STRUCTURE

(71) Applicant: Sun Yu Ta Co., Ltd., Chang-hua Hsien (TW)

(72) Inventor: Jung-Hua Liu, Chang-hua Hsien (TW)

(73) Assignee: Sun Yu Ta Co. Ltd., Changhua (TW)

( * ) Notice: Subject to any disclaimer, the term of this patent is extended or adjusted under 35 U.S.C. 154(b) by 0 days.

(21) Appl. No.: 14/303,703

(22) Filed: Jun. 13, 2014

(51) Int. Cl.

| | |
|---|---|
| ***A47B 43/00*** | (2006.01) |
| ***A47B 47/00*** | (2006.01) |
| *A47G 29/00* | (2006.01) |
| *A47F 5/00* | (2006.01) |
| *B65D 6/00* | (2006.01) |
| *B65D 8/14* | (2006.01) |
| *B65D 8/04* | (2006.01) |

(52) U.S. Cl.
CPC ..... *A47B 47/0075* (2013.01); *A47B 47/0016* (2013.01); *A47B 47/0091* (2013.01)

(58) Field of Classification Search
USPC ..... 211/72, 70.1, 189, 182, 183; 220/4.08, 220/4.04, 4.09, 4.11, 4.16, 685, 684, 683, 220/4.28, 4.31, 4.33, 4.34, 6; 206/600; 312/108, 111; 52/780
See application file for complete search history.

(56) References Cited

U.S. PATENT DOCUMENTS

| | | | | | |
|---|---|---|---|---|---|
| 1,177,311 | A | * | 3/1916 | Flannery | 138/158 |
| 2,100,773 | A | * | 11/1937 | Boeye | 229/5.7 |
| 3,081,023 | A | * | 3/1963 | Taylor | 232/24 |
| 3,661,434 | A | * | 5/1972 | Alster | 312/111 |
| 3,670,899 | A | * | 6/1972 | Kronenberg et al. | 211/182 |
| 3,739,833 | A | * | 6/1973 | Rausch et al. | 164/6 |
| 3,841,726 | A | * | 10/1974 | Andros et al. | 312/111 |
| 3,975,877 | A | * | 8/1976 | Walton | 52/282.3 |
| 4,050,604 | A | * | 9/1977 | Flanders | 220/4.28 |
| 4,089,417 | A | * | 5/1978 | Osborne | 206/600 |
| 4,126,366 | A | * | 11/1978 | Handler et al. | 312/249.2 |
| 4,211,033 | A | * | 7/1980 | Ringer | 47/45 |
| 4,355,485 | A | * | 10/1982 | Frank | 47/82 |
| 4,422,558 | A | * | 12/1983 | Mittelmann et al. | 220/1.5 |
| 4,612,726 | A | * | 9/1986 | Mori | 47/66.1 |
| 4,807,948 | A | * | 2/1989 | Baus | 312/258 |
| 4,969,568 | A | * | 11/1990 | Yoshida | 220/4.33 |
| 5,046,789 | A | * | 9/1991 | Lee | 312/108 |
| 5,083,327 | A | * | 1/1992 | Gillebaard | 4/506 |
| 5,265,750 | A | * | 11/1993 | Whiteley et al. | 220/4.31 |
| 5,333,970 | A | * | 8/1994 | Heselden | 405/286 |
| 5,466,057 | A | * | 11/1995 | Blankenburg | 312/108 |
| 5,740,648 | A | * | 4/1998 | Piccone | 52/426 |
| 5,765,707 | A | * | 6/1998 | Kenevan | 220/4.28 |
| 5,791,806 | A | * | 8/1998 | Giehl | 403/117 |

(Continued)

*Primary Examiner* — Joshua J Michener
*Assistant Examiner* — Devin Barnett
(74) *Attorney, Agent, or Firm* — Che-Yang Chen; Law Office of Michael Chen

(57) ABSTRACT

A combination rack structure includes a predetermined number of support plates, connecting strips and side frames. Each of the support plates has a rectangular shape. Each of the connecting strips is provided with three holding grooves each longitudinally extended through each of the connecting strips. Each of the connecting strips has a periphery provided with elongate recessed portions each located between any two of the holding grooves. Each of the recessed portions is provided with a plurality of extensions which are perpendicular to an axial direction of each of the recessed portions and are spaced from each other with a proper interval. The extensions are used for holding and resting. Each of the side frames is bent to have a hexagonal shape. The support plates are combined with the connecting strips to construct a hexagonal rack.

11 Claims, 12 Drawing Sheets

(56) References Cited

U.S. PATENT DOCUMENTS

| | | | | |
|---|---|---|---|---|
| 5,797,514 | A * | 8/1998 | Twiggar et al. | 220/683 |
| 5,899,337 | A * | 5/1999 | Thebeault | 206/600 |
| 5,943,709 | A * | 8/1999 | Chiu | 4/506 |
| 6,219,984 | B1 * | 4/2001 | Piccone | 52/426 |
| 6,241,148 | B1 * | 6/2001 | Schwimmer | 229/122.21 |
| 6,244,443 | B1 * | 6/2001 | Nickell et al. | 206/600 |
| 6,415,927 | B1 * | 7/2002 | Stone et al. | 206/600 |
| 6,783,058 | B2 * | 8/2004 | Quaintance | 229/109 |
| 7,328,833 | B1 * | 2/2008 | Wiley | 229/117.05 |
| 7,591,053 | B2 * | 9/2009 | Bosisio et al. | 27/35 |
| 7,604,133 | B2 * | 10/2009 | Tsai | 211/194 |
| 7,604,156 | B2 * | 10/2009 | Clohessy | 229/122.32 |
| 7,765,744 | B2 * | 8/2010 | Herron | 52/79.5 |
| 7,963,404 | B2 * | 6/2011 | Shang | 211/36 |
| 8,033,410 | B2 * | 10/2011 | Afflerbach et al. | 220/7 |
| 8,209,916 | B2 * | 7/2012 | Herron | 52/79.5 |
| 8,210,379 | B2 * | 7/2012 | Afflerbach et al. | 220/4.31 |
| 8,333,291 | B2 * | 12/2012 | Rosendahl | 220/4.11 |
| 8,376,167 | B2 * | 2/2013 | Lovelace et al. | 220/4.17 |
| D679,148 | S * | 4/2013 | Schwartz et al. | D7/629 |
| 2002/0008517 | A1 * | 1/2002 | Derby et al. | 324/318 |
| 2002/0056247 | A1 * | 5/2002 | Williams | 52/648.1 |
| 2002/0092247 | A1 * | 7/2002 | Thomas et al. | 52/136 |
| 2004/0118061 | A1 * | 6/2004 | Little | 52/270 |
| 2004/0118844 | A1 * | 6/2004 | Bennett et al. | 220/4.12 |
| 2004/0134869 | A1 * | 7/2004 | Yang et al. | 211/181.1 |
| 2004/0251300 | A1 * | 12/2004 | Perkins | 229/109 |
| 2006/0005497 | A1 * | 1/2006 | Foell et al. | 52/589.1 |
| 2006/0207957 | A1 * | 9/2006 | Chen | 211/188 |
| 2006/0261060 | A1 * | 11/2006 | Baez | 220/4.21 |
| 2008/0247830 | A1 * | 10/2008 | Heselden | 405/273 |
| 2008/0279634 | A1 * | 11/2008 | Heselden | 405/114 |
| 2010/0320165 | A1 * | 12/2010 | Wang | 211/182 |
| 2011/0011855 | A1 * | 1/2011 | Han | 220/4.33 |
| 2011/0192854 | A1 * | 8/2011 | Chen et al. | 220/660 |
| 2013/0186890 | A1 * | 7/2013 | Moody et al. | 220/4.16 |
| 2013/0295548 | A1 * | 11/2013 | Brazier | 434/365 |
| 2014/0077105 | A1 * | 3/2014 | Kawahara | 250/507.1 |

* cited by examiner

COMBINATION RACK STRUCTURE

BACKGROUND OF THE INVENTION

1. Field of the Invention

The present invention relates to a rack structure and, more particularly, to a combination rack structure.

2. Description of the Related Art

A conventional rack structure comprises metallic frames and support boards horizontally located between the metallic frames. The metallic frames are combined integrally by soldering or screwing. However, the conventional rack structure has a fixed construction and cannot be detached, thereby causing inconvenience in transportation and storage. In addition, the conventional rack structure has a determined volume so that it occupies a larger space of storage. Further, the conventional rack structure has a fixed configuration that cannot be changed according to the practical requirement so that the conventional rack structure is not available when the design or layout of the space of storage is changed.

BRIEF SUMMARY OF THE INVENTION

In accordance with the present invention, there is provided a combination rack structure comprising a predetermined number of support plates, a predetermined number of connecting strips, and a predetermined number of side frames. Each of the support plates has a rectangular shape. Each of the connecting strips is provided with three holding grooves each longitudinally extended through each of the connecting strips. Each of the connecting strips has a periphery provided with elongate recessed portions each located between any two of the holding grooves. Each of the recessed portions is provided with a plurality of extensions which are perpendicular to an axial direction of each of the recessed portions and are spaced from each other with a proper interval. The extensions are used for holding and resting. Each of the side frames is bent to have a hexagonal shape. In assembly, corners of each of the side frames are engaged in the recessed portions of each of the connecting strips and abut the extensions of each of the connecting strips. The support plates are combined with the connecting strips to construct a hexagonal rack. When edges of each of the support plates are inserted into the holding grooves of each of the connecting strips, the connecting strips clamp the side frames by a pulling action of the support plates.

Preferably, the hexagonal rack mates with a side frame, with the side frame abutting the extensions at an interior and a rear end of the hexagonal rack.

Alternatively, the hexagonal rack mates with two side frames, with the side frames abutting the extensions at an interior, a front end and a rear end of the hexagonal rack.

Preferably, each of the support plates has a closed surface.

Alternatively, each of the support plates has a surface provided with a plurality of hollows.

Preferably, a back plate is mounted on a rear portion of the hexagonal rack by a plurality of connecting members.

Preferably, a baffle is mounted in the hexagonal rack by a plurality of connecting members.

Preferably, each of the support plates has a front portion and a rear portion each provided with a reinforcing ribs each extending upward and downward, and each of the reinforcing ribs has two sides each provided with a recessed portion.

Preferably, each of the extensions at front and rear ends of each of the connecting strips is provided with at least one through hole.

Preferably, each of the support plates is made to have various predetermined specifications so that the hexagonal rack has variations of its size, depth and volume according to articles placed in the hexagonal rack.

Preferably, the holding grooves of each of the connecting strips are arranged in a substantially Y-shaped profile.

According to the primary advantage of the present invention, the side frames reinforces the strength of the hexagonal rack so that the hexagonal rack can withstand a larger load and heavier weight.

According to another advantage of the present invention, the side frames provide a hanging function to attach the hexagonal rack to a wall or a cabinet.

According to a further advantage of the present invention, the hexagonal rack can be disassembled quickly when not in use to efficiently reduce the whole volume, thereby saving the space of storage, and thereby facilitating transportation, packaging and storage.

According to a further advantage of the present invention, the hexagonal rack can be assembled easily without needing aid of a hand tool, thereby facilitating the user assembling the hexagonal rack.

According to a further advantage of the present invention, the support plates and the connecting strips are used commonly, so that multiple hexagonal racks can be assembled and combined together to form any configuration according to the requirement of space or vision, thereby enhancing the versatility of the hexagonal racks.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
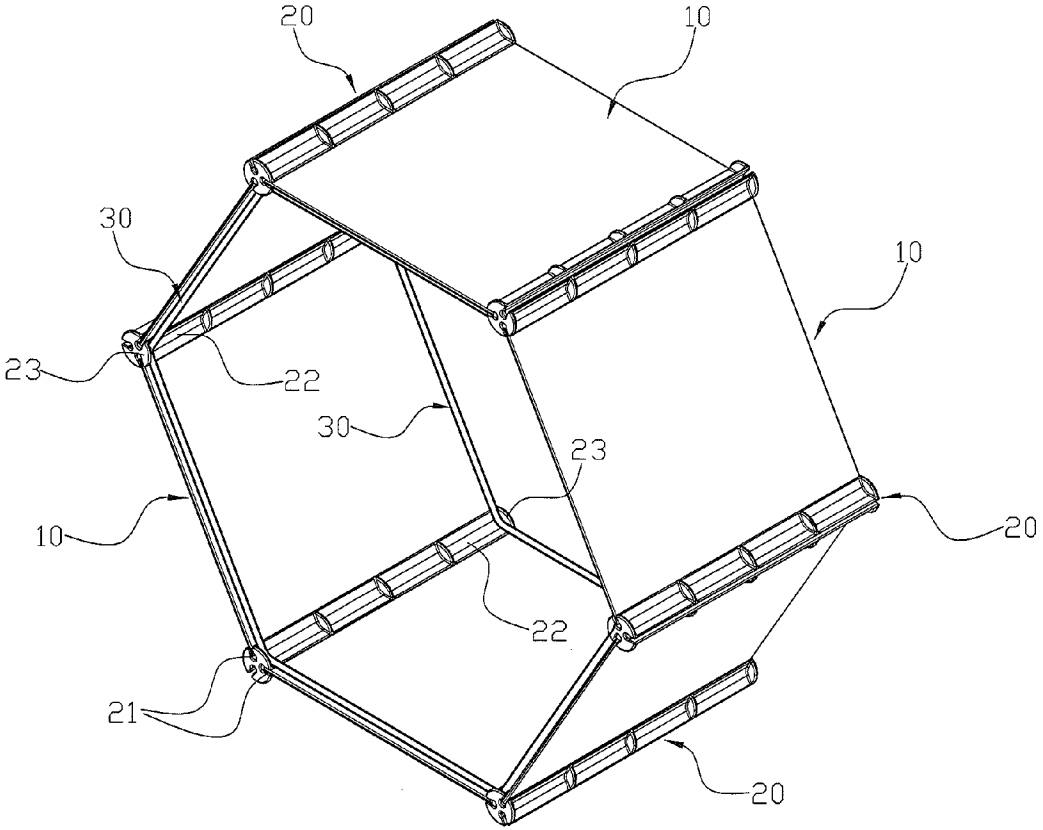
FIG. 1 is a perspective view of a combination rack structure in accordance with the first preferred embodiment of the present invention.

Referring to the drawings and initially to FIGS. 1-4, a combination rack structure in accordance with the preferred embodiment of the present invention comprises a predetermined number of support plates 10, a predetermined number of connecting strips 20, and a predetermined number of side frames 30.

Each of the support plates 10 has a rectangular shape. Each of the connecting strips 20 is provided with three holding grooves 21 each longitudinally extended through each of the connecting strips 20. The holding grooves 21 of each of the connecting strips 20 are arranged in a substantially Y-shaped profile. Each of the connecting strips 20 has a periphery provided with elongate recessed portions 22 each located between any two of the holding grooves 21. Each of the recessed portions 22 is provided with a plurality of extensions 23 which are perpendicular to an axial direction of each of the recessed portions 22 and are spaced from each other with a proper interval. The extensions 23 are used for holding and resting. Each of the side frames 30 is made of a metallic bar or metallic wire that is bent integrally to have a hexagonal shape.

In assembly, corners of each of the side frames 30 are engaged in the recessed portions 22 of each of the connecting strips 20 and abut the extensions 23 of each of the connecting strips 20. The support plates 10 are combined with the connecting strips 20 to construct a hexagonal rack. When edges of each of the support plates 10 are inserted into the holding grooves 21 of each of the connecting strips 20, the connecting strips 20 clamp the side frames 30 by a pulling action of the support plates 10. Each of the support plates 10 is made to have various predetermined specifications so that the hexagonal rack has variations of its size, depth and volume according to articles placed in the hexagonal rack.

In the preferred embodiment of the present invention, the hexagonal rack mates with a side frame 30, so that the side frame 30 abuts the extensions 23 at an interior and a rear end of the hexagonal rack.

In another preferred embodiment of the present invention, the hexagonal rack mates with two side frames 30, so that the side frames 30 abut the extensions 23 at an interior, a front end and a rear end of the hexagonal rack.

Figure 2:
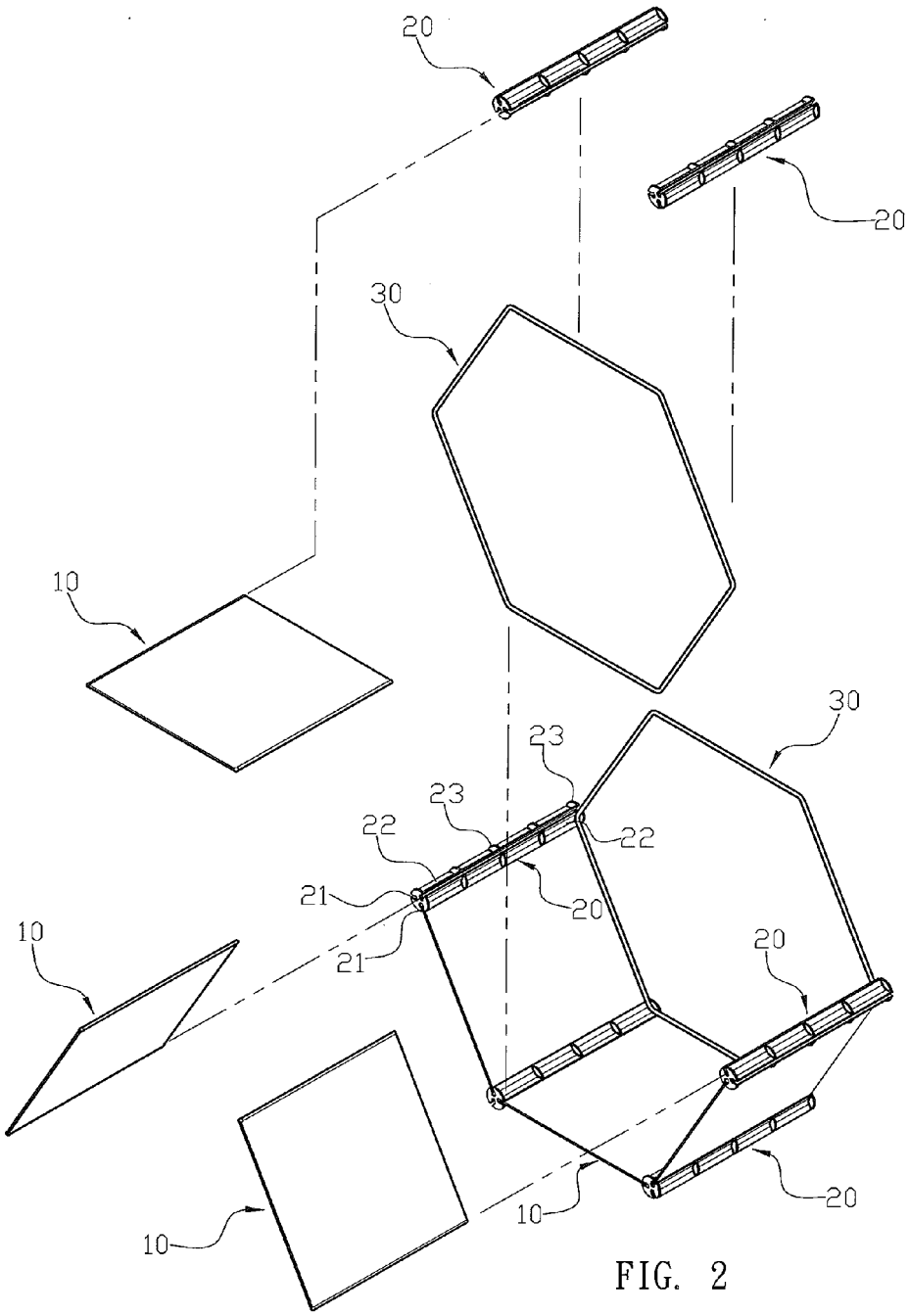
FIG. 2 is a partially exploded perspective view of the combination rack structure as shown in FIG. 1.
Figure 4:
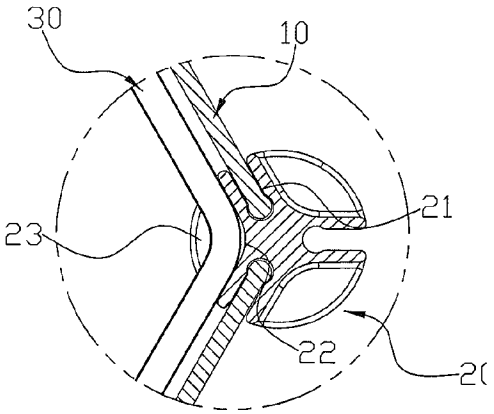
FIG. 4 is a locally enlarged view of the combination rack structure as shown in FIG. 3.
Figure 3:
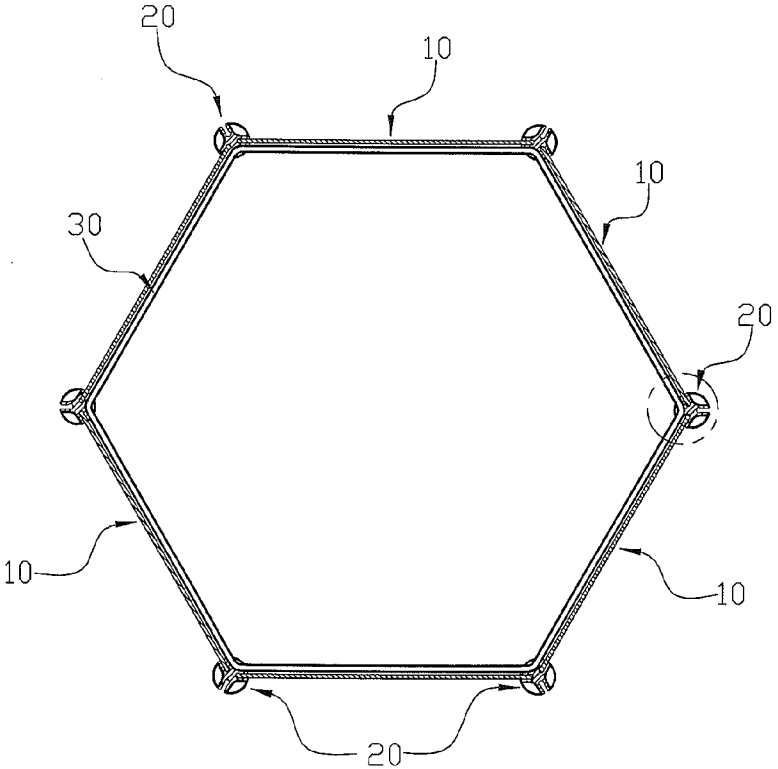
FIG. 3 is a cross-sectional view of the combination rack structure as shown in FIG. 1.

As shown in FIGS. 1 and 2, each of the support plates 10 has a closed surface.

Figure 5:
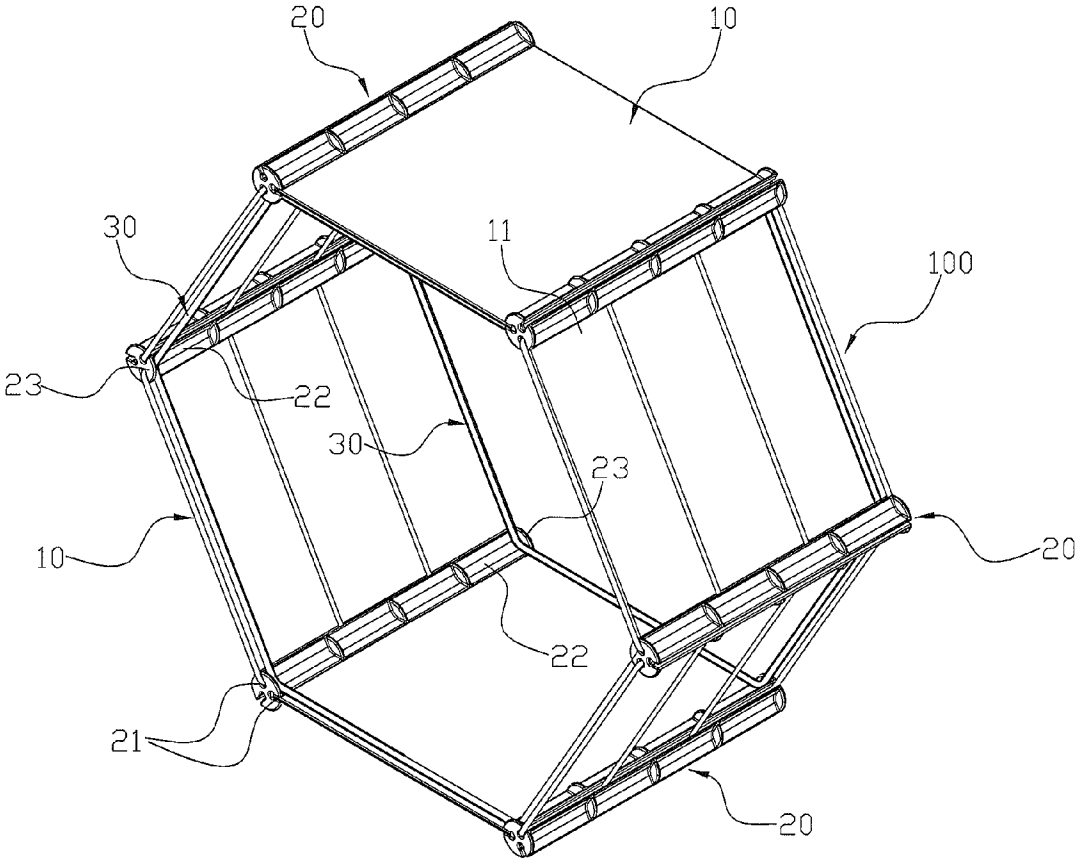
FIG. 5 is a perspective view of a combination rack structure in accordance with the second preferred embodiment of the present invention.
Figure 6:
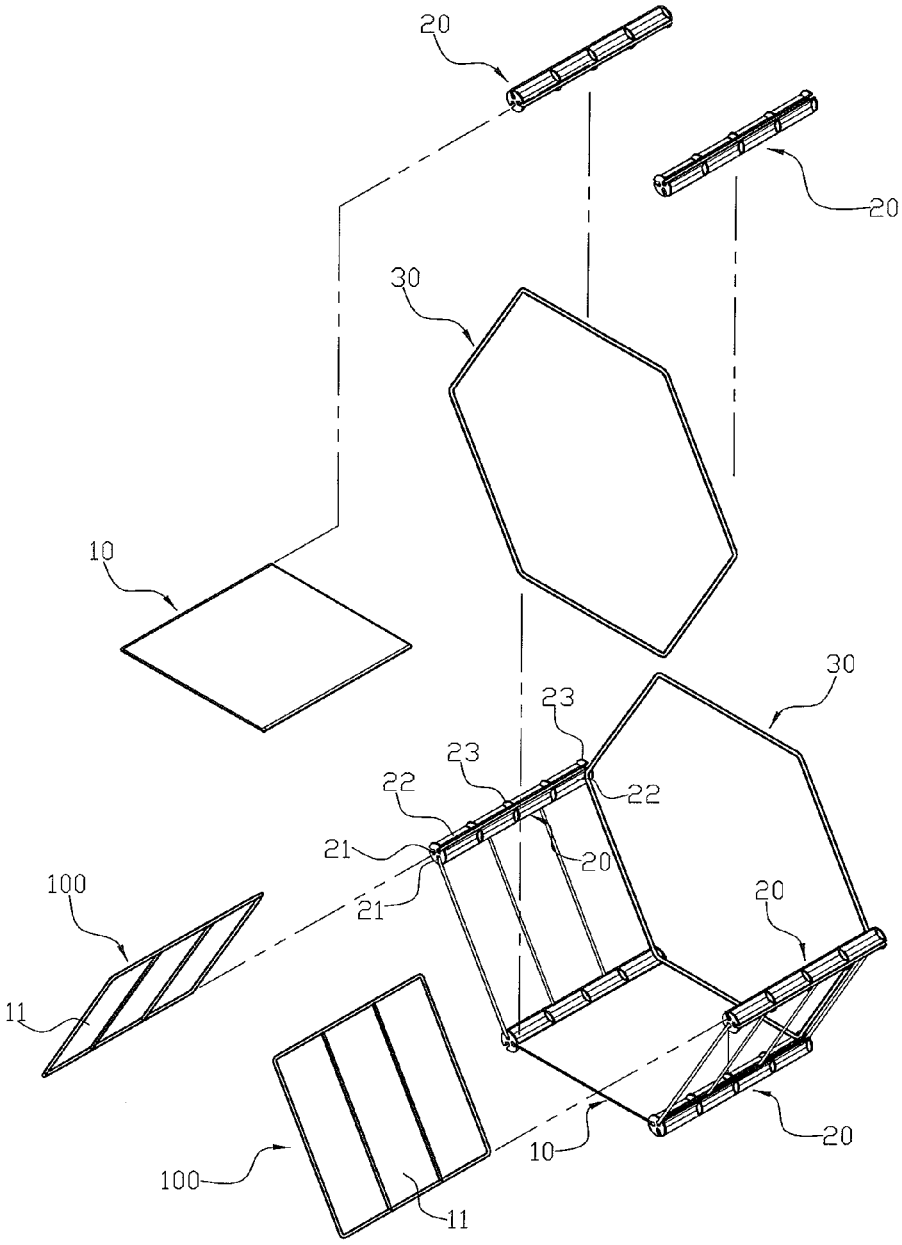
FIG. 6 is a partially exploded perspective view of the combination rack structure as shown in FIG. 5.

Referring to FIGS. 5 and 6, each of the support plates 100 is made of metallic material and has a surface provided with a plurality of hollows 11. Thus, the hexagonal rack includes the support plates 10 each having a closed surface and the support plates 100 each having a plurality of hollows 11.

Figure 7:
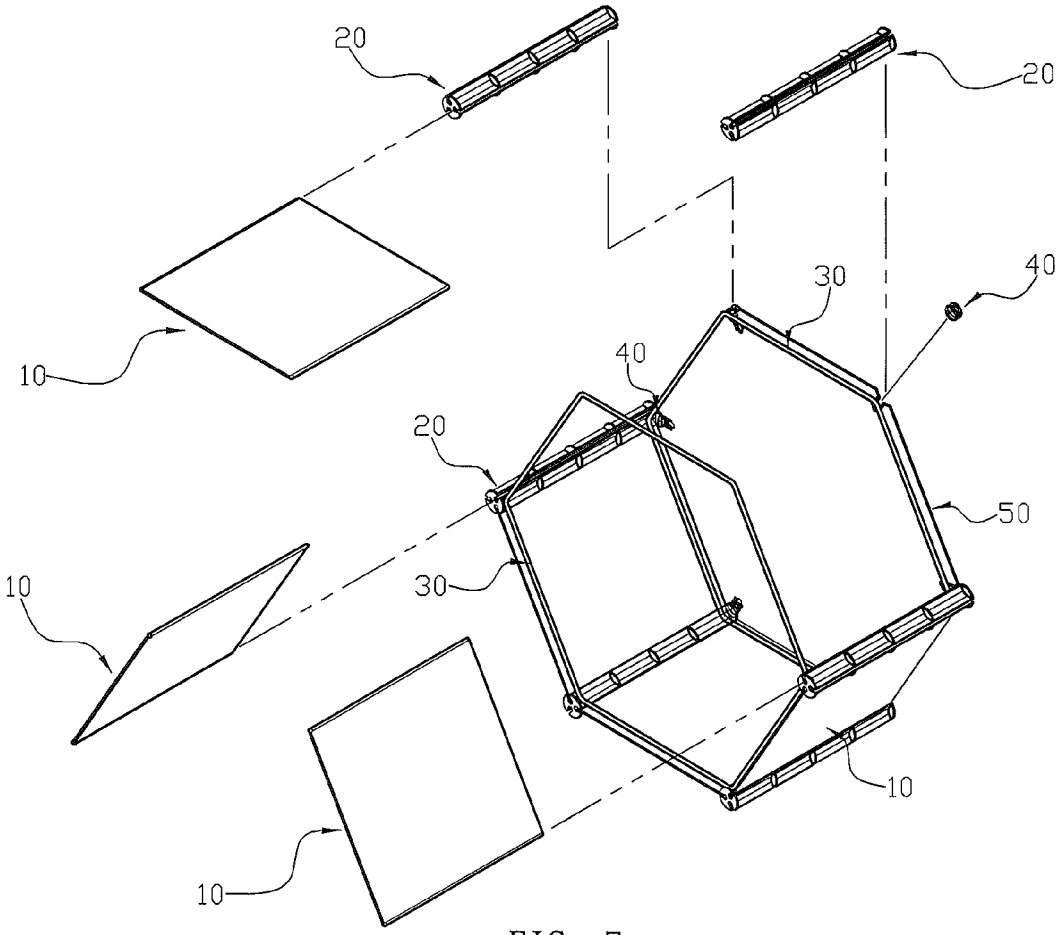
FIG. 7 is a partially exploded perspective view of a combination rack structure in accordance with the third preferred embodiment of the present invention.

Referring to FIG. 7, a back plate 50 is mounted on a rear portion of the hexagonal rack by a plurality of connecting members 40.

Figure 8:
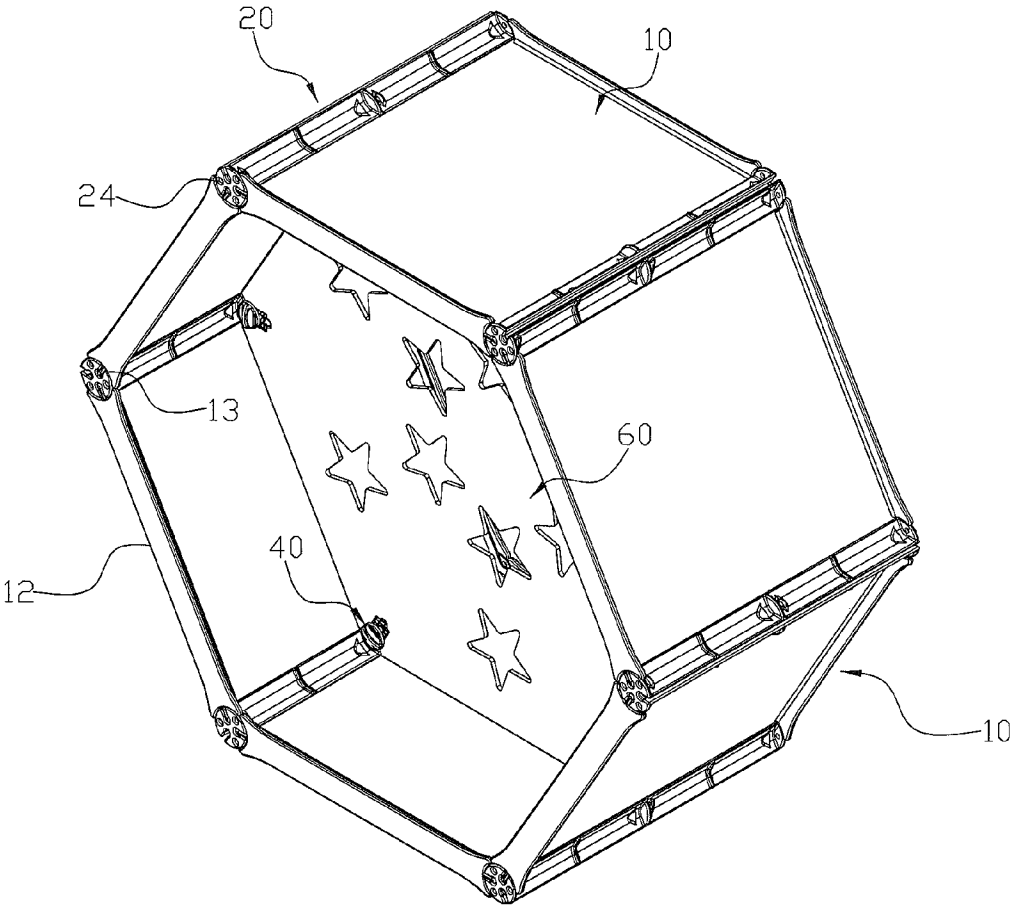
FIG. 8 is a perspective view of a combination rack structure in accordance with the fourth preferred embodiment of the present invention.
Figure 9:
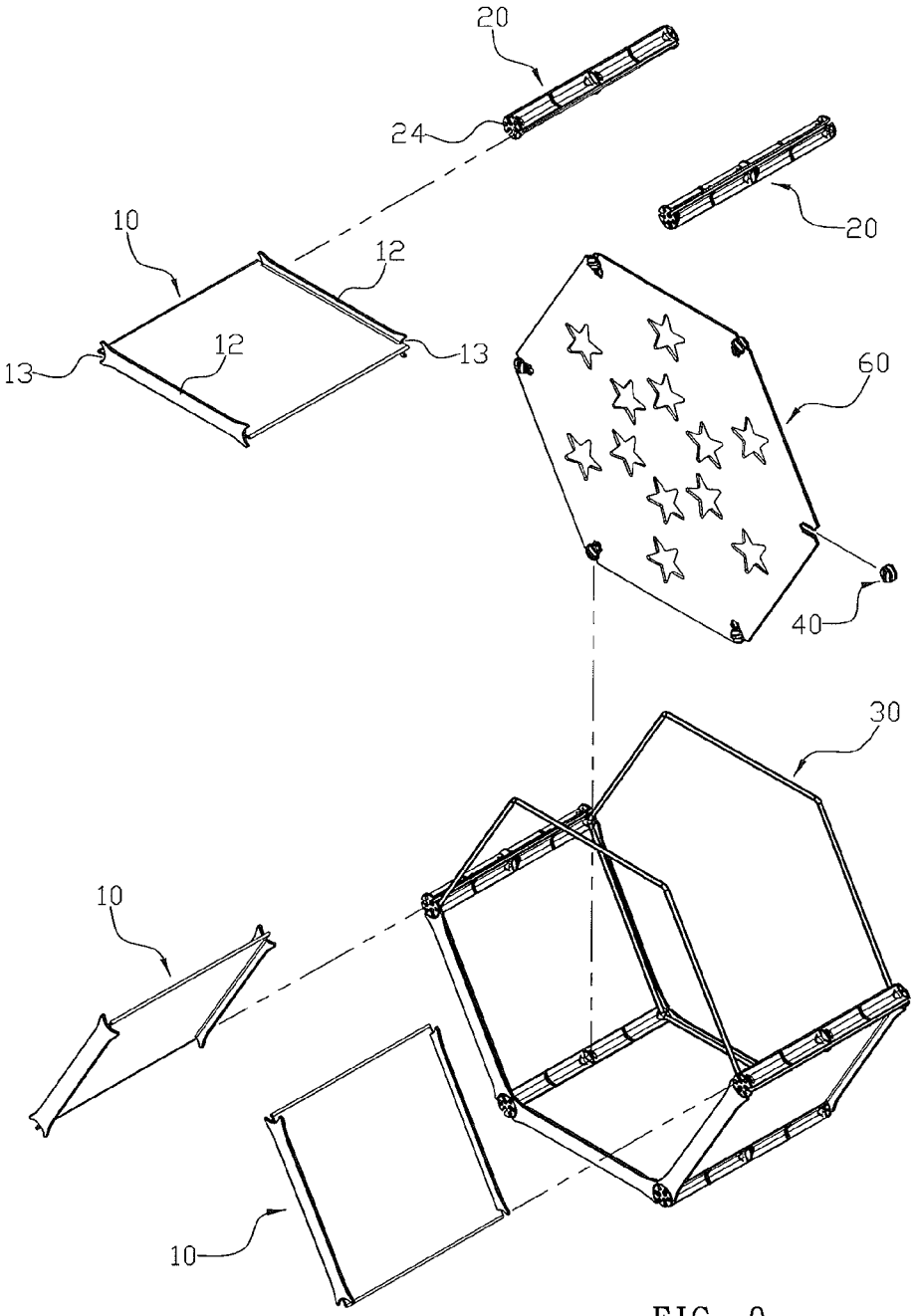
FIG. 9 is a partially exploded perspective view of the combination rack structure as shown in FIG. 8.
Figure 10:
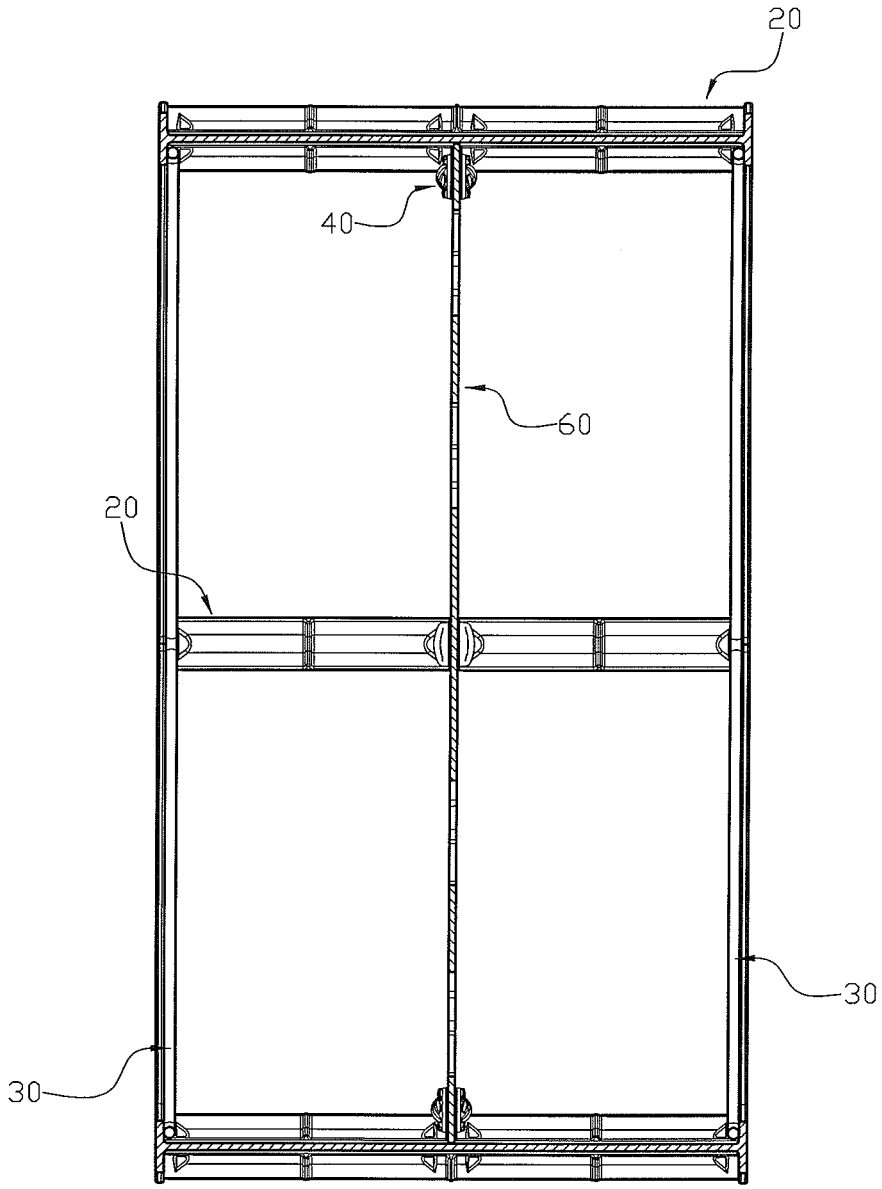
FIG. 10 is a cross-sectional view of the combination rack structure as shown in FIG. 8.

Referring to FIGS. 8-10, a baffle 60 is mounted in the hexagonal rack by a plurality of connecting members 40. Each of the support plates 10 has a front portion and a rear portion each provided with a reinforcing ribs 12 each extending upward and downward. The reinforcing ribs 12 greatly enhance the structural strength of the hexagonal rack. Each of the reinforcing ribs 12 has two sides each provided with a recessed portion 13 to allow evasion of each of the extensions 23 of each of the connecting strips 20. Each of the extensions 23 at front and rear ends of each of the connecting strips 20 is provided with at least one through hole 24 to allow insertion so that a horizontal support shelf is located between any two adjacent hexagonal racks.

When in use, the connecting strips 20 provide a supporting function to the hexagonal rack so that the hexagonal rack can be arbitrarily placed on any plane. By enclosure of the support plates 10 and 100 and the side frames 30, the hexagonal rack has an interior formed with a space to allow placement or storage of articles so that the articles can be gathered and collected to keep the environment clean.

Figure 11:
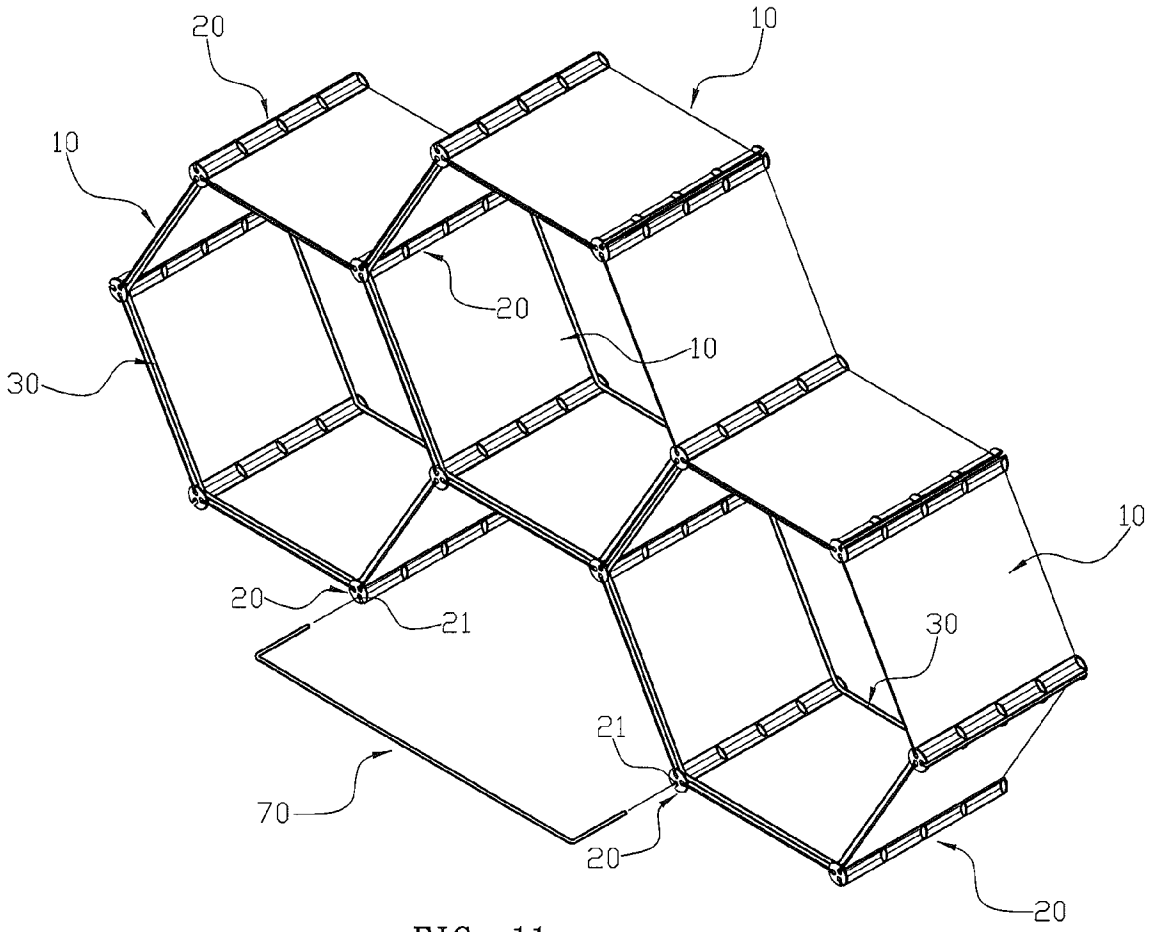
FIG. 11 is a perspective view showing usage of the combination rack structure.
Figure 12:
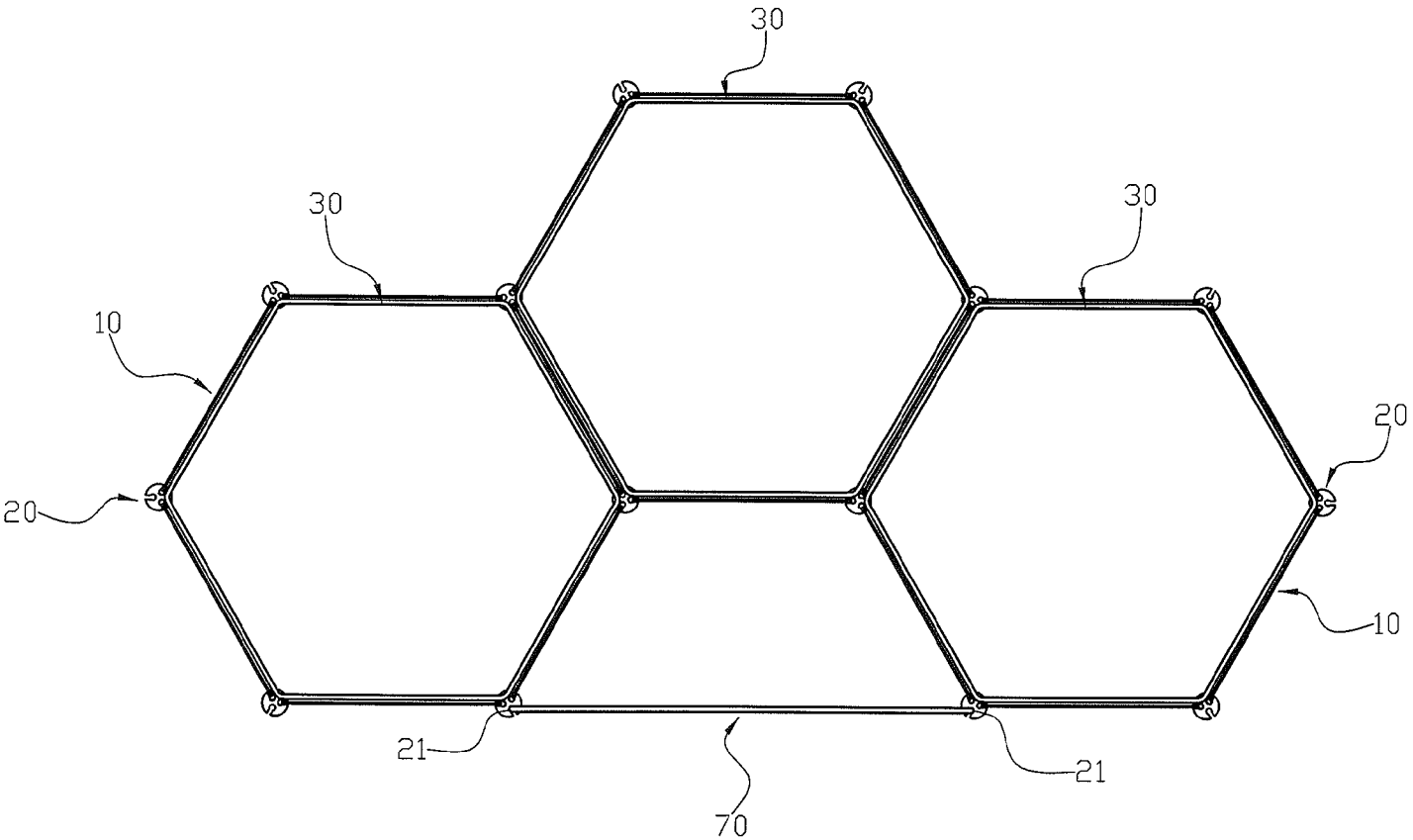
FIG. 12 is a plane view showing usage of the combination rack structure.

Referring to FIGS. 11 and 12, the support plates 10 and the connecting strips 20 can be used commonly, so that multiple hexagonal racks can be assembled and combined together to form any shape according to the requirement of space or vision. Thus, the hexagonal racks can be used universally and extensively without being limited by spatial variation. Preferably, a limit frame 70 is inserted into the holding grooves 21 of the connecting strips 20 of two adjacent hexagonal racks so that the hexagonal racks are combined solidly and stably and will not be collapsed due to a heavy weight of the articles placed in the hexagonal racks.

Figure 13:
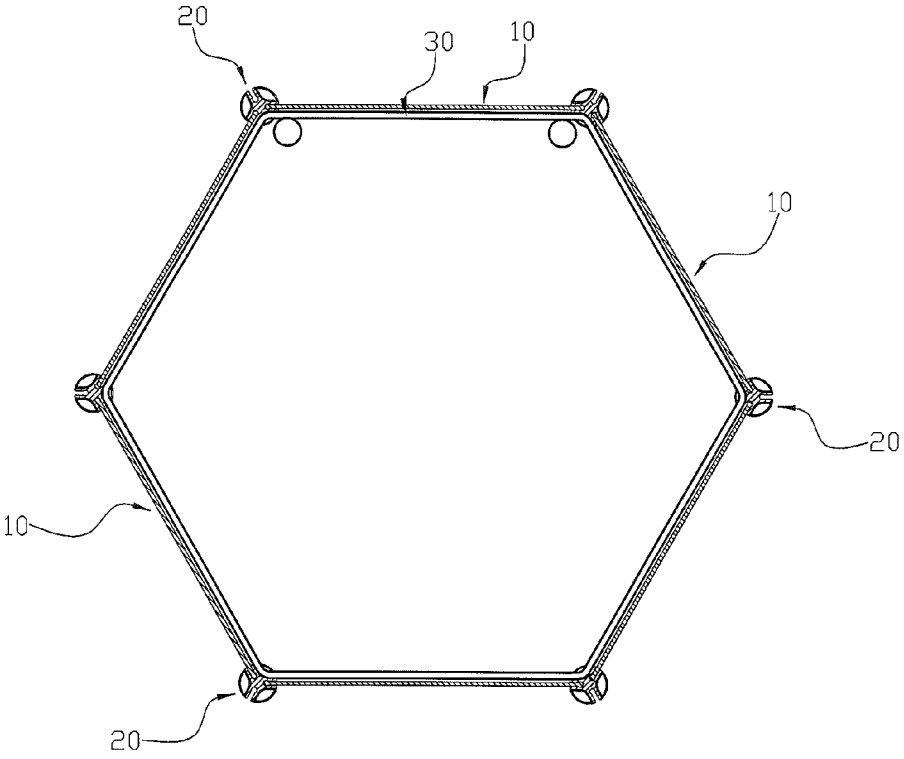
FIG. 13 is a plane view showing hanging of the combination rack structure.

Referring to FIG. 13, the side frames 30 have a hanging function so that the hexagonal rack can be attached to a wall or suspended on the door board of a cabinet.

Accordingly, the side frames 30 reinforces the strength of the hexagonal rack so that the hexagonal rack can withstand a larger load and heavier weight. In addition, the side frames 30 provide a hanging function to attach the hexagonal rack to a wall or a cabinet. Further, the hexagonal rack can be disassembled quickly when not in use to efficiently reduce the whole volume, thereby saving the space of storage, and thereby facilitating transportation, packaging and storage. Further, the hexagonal rack can be assembled easily without needing aid of a hand tool, thereby facilitating the user assembling the hexagonal rack. Further, the support plates 10 and the connecting strips 20 are used commonly, so that multiple hexagonal racks can be assembled and combined together to form any configuration according to the requirement of space or vision, thereby enhancing the versatility of the hexagonal racks.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A combination rack structure comprising:

a predetermined number of support plates, a predetermined number of connecting strips, and a predetermined number of side frames, wherein:

each of the support plates has a rectangular shape;

each of the connecting strips is provided with three holding grooves longitudinally extending through each of the connecting strips;

each of the connecting strips has a periphery provided with elongate recessed portions each located between any two of the holding grooves;

each of the recessed portions is provided with a plurality of extensions which are perpendicular to an axial direction of each of the recessed portions and are intervally spaced apart from each other;

corresponding extensions are used for holding and clamping the respective support plates;

each of the side frames is bent to have a hexagonal shape;

corners of each of the side frames are inserted in the recessed portions of each of the connecting strips and abut corresponding extensions of each of the connecting strips;

edges of each of the support plates are inserted into corresponding holding grooves of each of the connecting strips to construct a hexagonal rack, and the connecting strips clamp the side frames by a pulling action of the support plates to securely attach the side frames to the connecting strips and the support plates.

2. The combination rack structure of claim 1, wherein one of the side frames abuts corresponding extensions at an interior portion of the corresponding extensions at a rear end of the hexagonal rack.

3. The combination rack structure of claim 1, wherein the side frames abut the corresponding extensions at an interior portion of the corresponding extensions at a front end and a rear end of the hexagonal rack respectively.

4. The combination rack structure of claim 1, wherein each of the support plates has a continuous surface.

5. The combination rack structure of claim 1, wherein each of the support plates has a surface provided with a plurality of hollow portions.

6. The combination rack structure of claim 1, wherein a back plate is mounted on a rear portion of the hexagonal rack by a plurality of connecting members.

7. The combination rack structure of claim 1, wherein a baffle is mounted in the hexagonal rack by a plurality of connecting members.

8. The combination rack structure of claim 1, wherein each of the support plates are provided with reinforcing ribs extending along a width of each of the respective supporting plates, and each of the reinforcing ribs has two ends each provided with a recessed portion.

9. The combination rack structure of claim 1, wherein each of the support plates is a first set of support plates each having the same size.

10. The combination rack structure of claim 9, wherein the first set of support plates are each interchangeable with a corresponding sets of support plates, wherein each set of support plates has a different size so that the size, depth and volume of the hexagonal rack can be adjusted according to articles placed in the hexagonal rack.

11. The combination rack structure of claim 1, wherein the holding grooves of each of the connecting strips are arranged in a substantially Y-shaped profile.

* * * * *